US010406491B2

(12) United States Patent
Lee

(10) Patent No.: US 10,406,491 B2
(45) Date of Patent: Sep. 10, 2019

(54) IMPELLER-STRUCTURED SYSTEM FOR ROTOR-ROTOR-TYPE DISPERSION AND EMULSIFICATION APPARATUS

(71) Applicant: K&S COMPANY INC., Hwaseong-si, Gyeonggi-do (KR)

(72) Inventor: Bum-seop Lee, Suwon-si (KR)

(73) Assignee: K&S COMPANY INC., Hwaseong-si, Gyeonggi-do (KR)

( * ) Notice: Subject to any disclaimer, the term of this patent is extended or adjusted under 35 U.S.C. 154(b) by 61 days.

(21) Appl. No.: 15/316,982

(22) PCT Filed: May 4, 2016

(86) PCT No.: PCT/KR2016/004713

§ 371 (c)(1),
(2) Date: Mar. 9, 2017

(87) PCT Pub. No.: WO2016/178517

PCT Pub. Date: Nov. 10, 2016

(65) Prior Publication Data

US 2017/0173542 A1 Jun. 22, 2017

(30) Foreign Application Priority Data

May 6, 2015 (KR) ..... 10-2015-0063373

(51) Int. Cl.
*B01F 3/04* (2006.01)
*B01F 3/08* (2006.01)
(Continued)

(52) U.S. Cl.
CPC ..... *B01F 7/00875* (2013.01); *B01F 3/04453* (2013.01); *B01F 3/0807* (2013.01);
(Continued)

(58) Field of Classification Search
CPC ..... B01F 13/1016; B01F 2215/0059; B01F 3/04453; B01F 3/0807; B01F 3/0853;
(Continued)

(56) References Cited

U.S. PATENT DOCUMENTS 1,624,037 A * 4/1927 Butler ..... B01F 7/00758 209/191
2,009,957 A * 7/1935 Esch ..... B01F 7/00758 241/188.2
(Continued)

FOREIGN PATENT DOCUMENTS

KR 10-2002-0046913 A 6/2002
KR 10-0375296 B1 3/2003
(Continued)

*Primary Examiner* — Tony G Soohoo
(74) *Attorney, Agent, or Firm* — Novick, Kim & Lee, PLLC; Jae Youn Kim

(57) ABSTRACT

A system structure of an impeller for a dispersion-emulsion apparatus based on dual rotor is provided. This system includes an impeller unit in which an impeller constituted by a first rotor and a second rotor is configured in multi stages, in which the first rotor and the second rotor are driven in reverse rotational states to each other by driving motors of the respective rotors and respective target materials to be mixed sequentially pass between the multi-stage impeller units at once by a one-pass method, and as a result, a total working time for processing of dispersion-emulsion is significantly shortened, uniformity of a particle size is enhanced by micro shearing (cutting) of the respective mixed materials.

7 Claims, 9 Drawing Sheets

(51) Int. Cl.
*B01F 3/12* (2006.01)
*B01F 7/00* (2006.01)
*B01F 7/22* (2006.01)
*B01F 13/10* (2006.01)

(52) U.S. Cl.
CPC ..... *B01F 3/0853* (2013.01); *B01F 3/1221* (2013.01); *B01F 7/00341* (2013.01); *B01F 7/00633* (2013.01); *B01F 7/00866* (2013.01); *B01F 7/22* (2013.01); *B01F 13/1016* (2013.01); *B01F 2215/0059* (2013.01)

(58) Field of Classification Search
CPC ..... B01F 3/1221; B01F 7/00341; B01F 7/00633; B01F 7/00866; B01F 7/00875; B01F 7/22
See application file for complete search history.

(56) References Cited

U.S. PATENT DOCUMENTS 2,685,436 A * 8/1954 Hasselquist ..... B01F 3/04453 261/84
3,044,685 A * 7/1962 Lapiken ..... F04D 17/127 244/23 R
3,331,905 A * 7/1967 Hint ..... B02C 13/205 106/705
3,779,531 A * 12/1973 White ..... B01F 3/04539 210/219
4,522,342 A * 6/1985 Munschenborn ..... B02C 13/22 241/188.2
4,786,183 A * 11/1988 Cadeo ..... B01F 7/1625 366/263
4,813,619 A * 3/1989 Tjumanok ..... B02C 13/205 241/188.1
5,061,456 A * 10/1991 Brazelton ..... C02F 1/5227 366/172.2
5,252,635 A * 10/1993 Brazelton ..... B01F 3/0807 210/696
5,275,631 A * 1/1994 Brown ..... B02C 13/205 44/505
5,417,544 A * 5/1995 Mohn ..... F04D 1/003 415/213.1
5,449,122 A * 9/1995 Berger ..... B02C 7/12 241/261.2
5,460,444 A * 10/1995 Howorka ..... B28C 5/0881 366/103
5,575,824 A * 11/1996 Brown ..... B03C 7/006 44/505
5,727,743 A * 3/1998 Schneid ..... B01F 7/00758 241/261.3
5,845,856 A * 12/1998 Tanaka ..... B02C 13/22 241/79.1
5,906,853 A * 5/1999 Smith ..... A01J 25/002 366/325.5
6,286,771 B1 * 9/2001 Brown, Jr. ..... B02C 13/205 241/162
8,757,387 B2 * 6/2014 Makino ..... B07B 4/06 209/139.1
9,387,498 B2 * 7/2016 Hagata ..... B01F 5/104
2001/0036125 A1 * 11/2001 Bachelier ..... B01F 7/00758 366/294
2009/0000986 A1 * 1/2009 Hassan ..... B01F 7/00766 208/108
2010/0266519 A1 * 10/2010 Hasegawa ..... A61K 8/37 424/69
2013/0019972 A1 * 1/2013 Odagi ..... B01F 3/0807 137/572
2017/0173542 A1 * 6/2017 Lee ..... B01F 3/04453

FOREIGN PATENT DOCUMENTS

KR 10-0499199 B1 7/2005
KR 10-2012-0064647 A 6/2012
KR 10-1221850 B1 1/2013
KR 10-1405107 B1 6/2014
KR 10-2014-0135760 A 11/2014

* cited by examiner

IMPELLER-STRUCTURED SYSTEM FOR ROTOR-ROTOR-TYPE DISPERSION AND EMULSIFICATION APPARATUS

TECHNICAL FIELD

The present invention relates to a system structure of an impeller for a dispersion-emulsion apparatus based on dual rotor, and more particularly, to a system structure of an impeller for a dispersion-emulsion apparatus based on dual rotor, which includes an impeller unit in which an impeller constituted by a first rotor and a second rotor is configured in multiple stages, in which the first rotor and the second rotor are driven in reverse rotational states to each other by driving motors of the respective rotors, and respective target materials to be mixed sequentially pass between the multi-stage impeller units at once by a one-pass method, and as a result, a total working time for processing of dispersion-emulsion is significantly shortened, uniformity of a particle size is enhanced by micro shearing (cutting) of the respective mixed materials (target materials), and the dispersion-emulsion processing is rapidly and accurately performed.

BACKGROUND ART

In a basic material industry related to each technical field including foods, cosmetics, ink, paint, adhesive, coating agent, fine chemical, medicine, new nanomaterials, and advanced electronic materials, generally, any one selected material and another material are mixed to be used as a basic material.

For the materials to be mixed as the base material, uniformity and fineness of the mixing by the processes of dispersion and emulsion of respective particles influence the quality of a finished product, and various types of dispersion and emulsion apparatuses which are suitable for these requirements have been developed and used.

Dispersion (homogenization) is a method in which the sizes of the particles are decreased, as a solid which contains powder is homogeneously mixed in a liquid or the liquid is homogeneously mixed in another liquid, and as a result, the particles uniformly exist in a stable state. And it may be divided into suspension in which "the solid" is mixed with "the liquid", and emulsion in which "a first liquid" and "a second liquid" having an interface are mixed.

Therefore, the dispersion (homogenization) means to make the particle size smaller, and making the particle size smaller is to make the particle size smaller by applying strong energy (driving force) to a corresponding material for it to be ground, sheared, or cut.

A traditional dispersion and emulsion apparatus is a high-pressure type homogenizer, which makes the target materials collide with a wall or inverted by converting pressure (energy) to a jet stream to convert kinetic energy to shear energy, thereby achieving the dispersion and the emulsion. In such a scheme, there is a problem that pressure and velocity gradient exist in a reactant (materials to be mixed) in a processing procedure and air dissolved in contents thus generates bubbles, the mixed particles are uneven by the bubbles, and a long time is required for smooth dispersion and emulsion of the materials, and as a result, efficiency deteriorates.

Meanwhile, mixing will be discussed in more detail compared with dispersion.

The dispersion represents a state in which the particles of the materials are made very small and the particles are distributed uniformly and stably with each other. Unlike dispersion, mixing represents just mixing the materials (substances).

When a propeller and an impeller are rotated by using mixing equipment such as overhead mixer, two materials are mixed by the rotation of a blade of the impeller, and this is simply mixing where the homogenization process, which is the process of making the particle size small, is omitted.

A unit indicating a degree of particle size reduction in the mixing process is "shearing force". And the difference between the mixing and the dispersing is very great as shown below.

| | Stirrer or Mixer | Disperser |
|---|---|---|
| Tip Speed | 0~10 m/s | 10~24 m/s |
| Clearance | ~250 mm | 5 mm or less |
| Shearing Force | 0~40 | 2,000~4,8000 |

Shearing Force = Tip Speed/Clearance
Tip Speed: Instantaneous speeds of rotor and impeller
Clearance: The gap between rotor and stator or the gap between impeller and vessel wall Meanwhile, a largest issue in performance of the dispersion is viscosity of a material to be dispersed. Dispersion efficiency deteriorates at the viscosity of approximately 2000 mPas or above, and when the viscosity becomes 5000 mPas, dispersion using a general apparatus is not performed.

For materials with viscosity, the shearing force should be increased by increasing the rotational speed of the impeller to increase the tip speed of the rotor, and by installing fence to reduce the numerical value of the clearance or the gap.

FIG. 1 is a functional configuration diagram of an ultrasonic dispersion-emulsion apparatus by an embodiment of conventional technology. The ultrasonic dispersion-emulsion apparatus may be described with reference to the accompanying drawing. The ultrasonic dispersion-emulsion is a scheme that when 20 kHz ultrasound is emitted into a solution with a strong intensity, numerous microcavities are generated in the solution, and when the microcavities are broken, shock wave energy with a high temperature and high pressure is generated, and the particles of the material to be dispersed are broken to be very small (fine) by the shock wave energy.

Since the dispersion-emulsion scheme using the ultrasound is very effective, there is advantage that it can enable nanoscale dispersion-emulsion, but a long working time is required for a material with viscosity and it has a limitation in the uniformity and homogeneity of the mixture.

FIG. 2 is a functional configuration diagram of a rotor-stator type dispersion-emulsion apparatus by an embodiment of conventional technology.

To explain the dispersion-emulsion apparatus with reference to the accompanying drawing, it is a scheme in which the dispersion-emulsion apparatus is constituted by a fixed stator and a rotating rotor, and the particles of the target materials (substances) passing between the rotor and the stator are finely broken by strong shearing force generated by strong rotational energy to achieve the dispersion-emulsion.

The tip speed of the rotor which rotates at a speed of tens of thousands of rpms by a motor having strong rotary force reaches approximately 20 m/sec, and the material to be dispersed passes between the rotor and the stator at a tremendous speed. In this case, the clearance between the rotor and the stator, that is, the gap between the rotor and the stator forms a very small gap of approximately 0.1 mm, and when the material to be dispersed passes through the small gap between the rotor and the stator at a strong rotational speed, tremendous sharing force is generated and the particle is thus instantaneously sheared or cut into a very small size.

Such a rotor-stator type was developed decades ago and IKA of Germany had owned a patent right on such a rotor-stator type for a long time, and at present, the method has already been opened as the patent expired.

An advantage of such a scheme is that high-viscosity dispersion is possible, a dispersion-emulsion effect is excellent in terms of convenience of a process. Currently, the rotor-stator type dominates the main stream of most dispersion-emulsion apparatus, commercialized equipments are already in the market, though there are differences of performances from product to product.

However, for the dispersion-emulsion of micro-particles of nanoscale, there are still some problems. For example, mixing is not well performed and long processing time is required.

Therefore, it is necessary to develop more advanced technology so as to increase the shearing force to homogenize the particles and improve the uniformity of the particle size, and to improve the processing time for the dispersion-emulsion of the nanoscale microparticles.

PRIOR ART DOCUMENT

Patent Document (Patent Document 1) Korean Patent Application No. 10-2001-0053204 (Aug. 31, 2001) "TURBINE ROTOR-STATOR LEAF SEAL AND RELATED METHOD"

(Patent Document 2) Korean Patent Application No. 10-2014-7025991 (Jan. 24, 2013) "VANE-TYPE PUMP HAVING A HOUSING, HAVING A DISPLACEABLE STATOR, AND HAVING A ROTOR THAT IS ROTATABLE WITHIN THE STATOR"

DISCLOSURE

To solve the above-mentioned problems, the present invention adopts an impeller structure base on dual rotor system to improve a conventional impeller based on rotor-stator structure. That is, the objective of the present invention is to provide rotor-rotor type dispersion-emulsion impeller system structure where a first rotor and a second rotor constitute multi-stage impeller, which allows a material for dispersion-emulsion to pass through the multi-stage impellers sequentially so that dispersion-emulsion process is performed by one-pass scheme, to reduce overall working time, increase the particle homogeneity, and enhance particle uniformity.

However, the an objective of the present invention is not limited to the aforementioned one, and other objectives, which are not mentioned above, will be apparent to those skilled in the art from the following description.

Technical Solution

To achieve the above-mentioned objectives, the present invention provides a system structure of an impeller for a dispersion-emulsion apparatus based on dual rotor system comprising:

a first rotor 30*a* having one or more multiple first rotor teeth 310 which have a disk shape and protrude downward arranged at a regular interval along one or more multiple concentric circumferences and fixedly installed on the outer periphery of a first driving shaft 13 inserted through an opened first shaft fixation hole 312 at the center;

and a second rotor 30*b* having one or more multiple second rotor teeth 320 which have the disk shape and protrude upward arranged at the regular interval along one or more multiple concentric circumferences and fixedly installed on the outer periphery of a second driving shaft 23 while an outer edge is fixed to a second rotor fixation bracket 230 and rotational center axes coincide with each other, wherein the first rotor 30*a* and the second rotor 30*b* may be coupled to face each other and the first rotor 30*a* and the second rotor 30*b* may be coupled to each other in the state where the first rotor teeth 310 and the second rotor teeth 320 form an interval, the first rotor teeth 310 and the second rotor teeth 320 may be arranged on the concentric circumference and the first rotor teeth 310 and the second rotor teeth 320 are arranged on different circumferences, and when the first rotor 30*a* and the second rotor 30*b* are coupled to face each other, the first rotor teeth 310 and the second rotor teeth 320 may be repeatedly disposed to cross each other in the state where the first rotor teeth 310 and the second rotor teeth 320 are adjacent to each other by different concentric circumferences.

The first driving shaft 13 may be connected with a first motor 11 through a first belt 12 and rotate unidirectionally in a first direction by driving the first motor 11, the second driving shaft 23 may be connected with a second motor 21 through a second belt 22 and rotate unidirectionally in a second direction by driving the second motor 21, and the first direction and the second direction may be opposite to each other.

The first rotor 30*a* and the second rotor 30*b* may constitute a unit impeller and the unit impeller may be configured by a multi-stage impeller of any one unit selected among units of 1 to 10.

The second rotor 30*b* may be fixedly coupled by screw-fastening the disk-shaped outer edge to a first fixation portion 232 of a second rotor fixation bracket 230, and the second fixation shaft 23 may be fixedly coupled by screw-fastening to a second fixation portion 234 of the fixation bracket 230.

The first driving shaft 13 may be fixedly installed at the center of the top of a cylinder 30 having a cylindrical shape in a rotational state, the second driving shaft 23 may be fixedly installed at the center of the bottom of a cylinder 30 having a cylindrical shape in a rotational state, and the first rotor 30*a* and the second rotor 30*b* may be configured to be installed inside the cylinder 30.

The first driving shaft 13 may penetrate the top of the cylinder 30 in a sealed state by a first mechanical seal 14 and may be fixedly coupled and installed in the rotational state, the second driving shaft 23 may penetrate the bottom of the cylinder 30 in the sealed state by a second mechanical seal 24 and may be fixedly coupled and installed in the rotational state, and a rotational axis center of the first driving shaft 13 and the rotational axis center of the second driving shaft 23 may be configured to be positioned on the same vertical line.

The cylinder 30 may further include an inlet 31 formed on the lower part of the cylinder 30, through which a material is put in, and an outlet 32 formed on the upper part of the cylinder 30, through which the material is discharged from the inside, a rotational axis center line of the first motor 11 and the rotational axis center line of the second motor 21 may form any one value selected in a range of 0 to 180° from the plane based on a vertical line formed by extending the rotational axis center of the first driving shaft 13 and the rotational axis center of the second driving shaft 23, or are disposed at the same position, and the inlet 31 and the outlet 32 may form any one value selected in a range of 0 to 180° from the plane based on the vertical line formed by extending the rotational axis center of the first driving shaft 13 and the rotational axis center of the second driving shaft 23, or are disposed at the same position.

The system structure may further include a material suction pump 33 installed on a front end of the inlet 31 of the cylinder 30 and facilitating the flow of a high-viscosity material into the cylinder 30.

Advantageous Effects

In the present invention, the problems of a conventional rotor-stator type impeller are improved and rotor-rotor type impeller configuration is adopted and applied.

Since a dispersion-emulsion process is performed with a one-pass processing procedure by the configuration of an impeller constituted by a first rotor and a second rotor in multi stages and by allowing the material to be dispersed and emulated while sequentially passing through the multi-stage impellers, the advantages of the present invention include shortened overall working time by strong shearing force and improved particle uniformity of a material to be mixed.

DETAILED DESCRIPTION OF THE PREFERRED EMBODIMENTS

Hereinafter, a preferred embodiment of the present invention will be described in detail with reference to the accompanying drawings. Hereinbelow, in describing the present invention, detailed description of associated known function or constitutions will be omitted if they make the gist of the present invention unclear.

In the following description, a rotor and an impeller may be used as the same meaning and selectively used for smooth contextual description. In the following description, a material and a substance may be used as the same meaning and selectively used for smooth contextual description.

Figure 3:
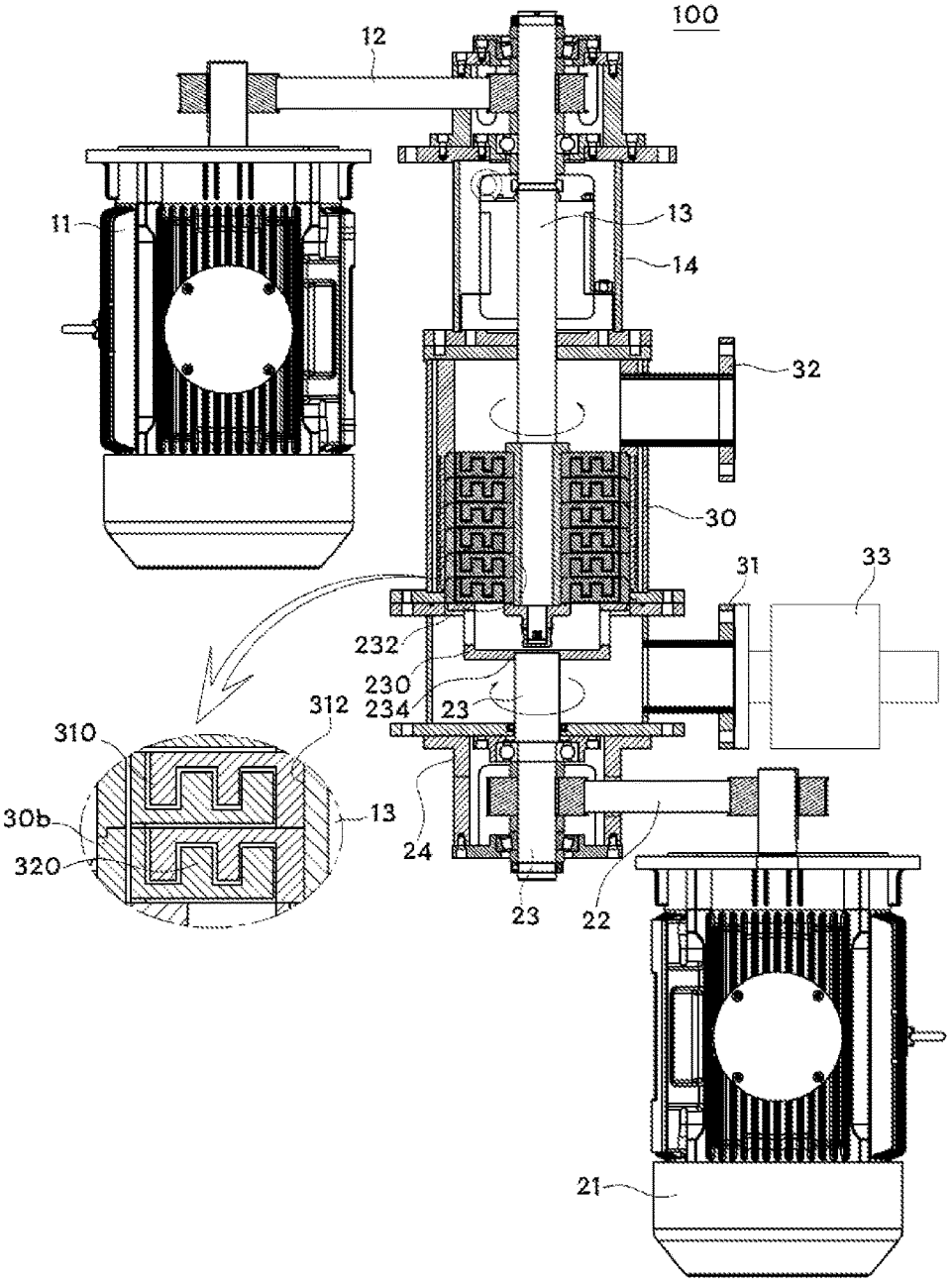
FIG. 3 is a diagram illustrating a system structure 100 of an impeller for a rotor-rotor type dispersion-emulsion apparatus by an embodiment of the present invention.

FIG. 3 is a diagram illustrating a system structure 100 of an impeller for a rotor-rotor type dispersion-emulsion apparatus by an embodiment of the present invention.

Hereinafter, when described with reference to FIG. 3 which is accompanied, the system structure 100 of an impeller for a dispersion-emulsion apparatus based on dual rotor is configured to include a first motor 11, a first belt 12, a first driving shaft 13, a first mechanical seal 14, a second motor 21, a second belt 22, a second driving shaft 23, a second mechanical seal 24, a cylinder 30, a first rotor 30*a*, a second rotor 30*b*, an inlet 31, an outlet 32, and a material suction pump 33.

Figure 1:
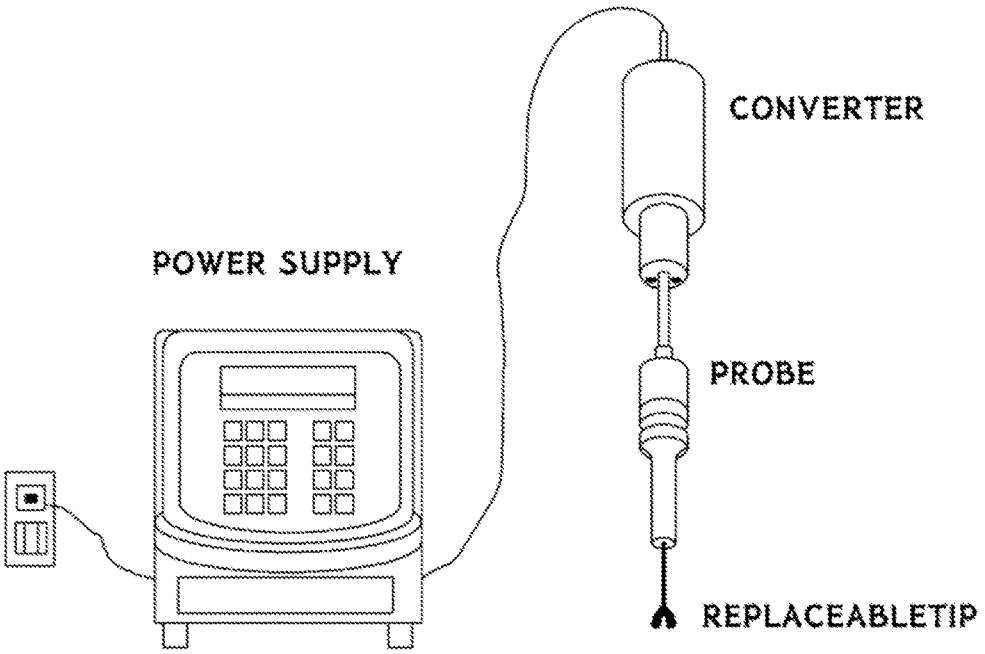
FIG. 1 PRIOR ART
FIG. 1 is a functional configuration diagram of an ultrasonic dispersion-emulsion apparatus by an embodiment of conventional technology.
Figure 2:
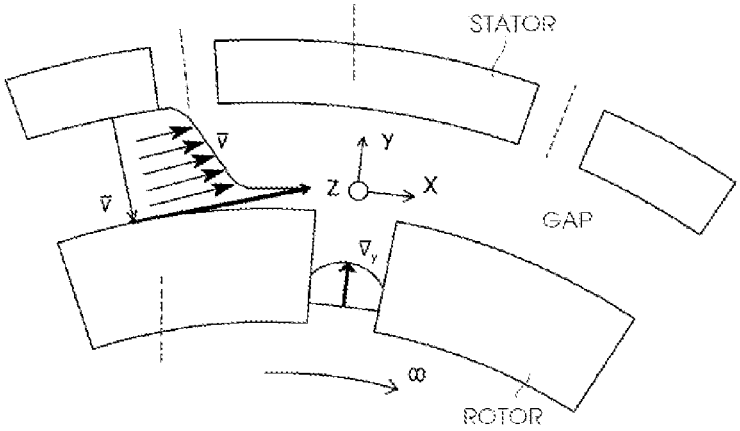
FIG. 2 PRIOR ART
FIG. 2 is a functional configuration diagram of a rotor-stator type dispersion-emulsion apparatus by an embodiment of conventional technology.
Figure 2:
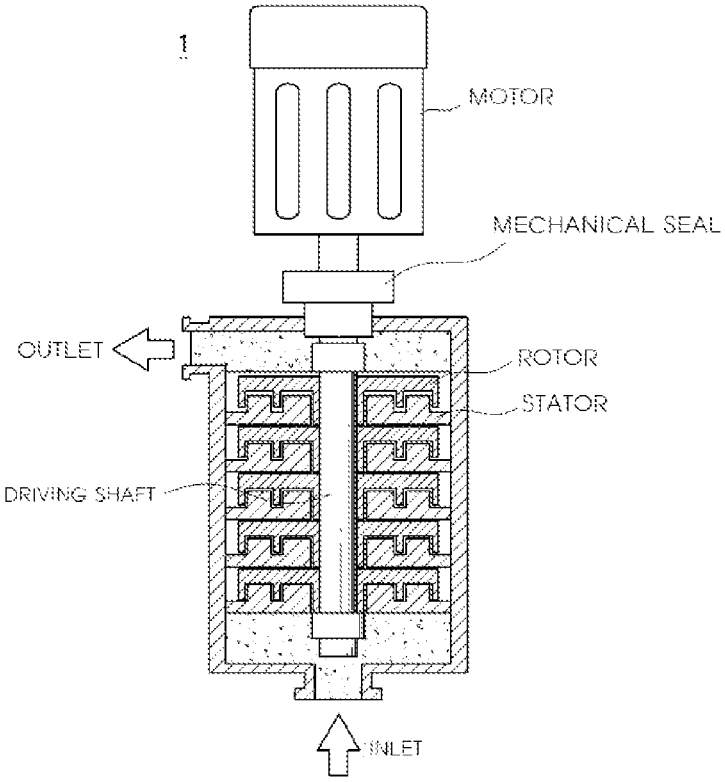
FIG. 2 PRIOR ART

The system structure 100 of an impeller for a dispersion-emulsion apparatus based on dual rotor may be classified into not a rotor-stator type but a rotor-rotor type as illustrated in FIG. 2 accompanied to describe conventional technology and the process from the injection of a raw material or a raw substance to be mixed up to shearing, dispersion, mixing, emulsion, and discharge may be processed by a one-pass scheme.

Figure 4:
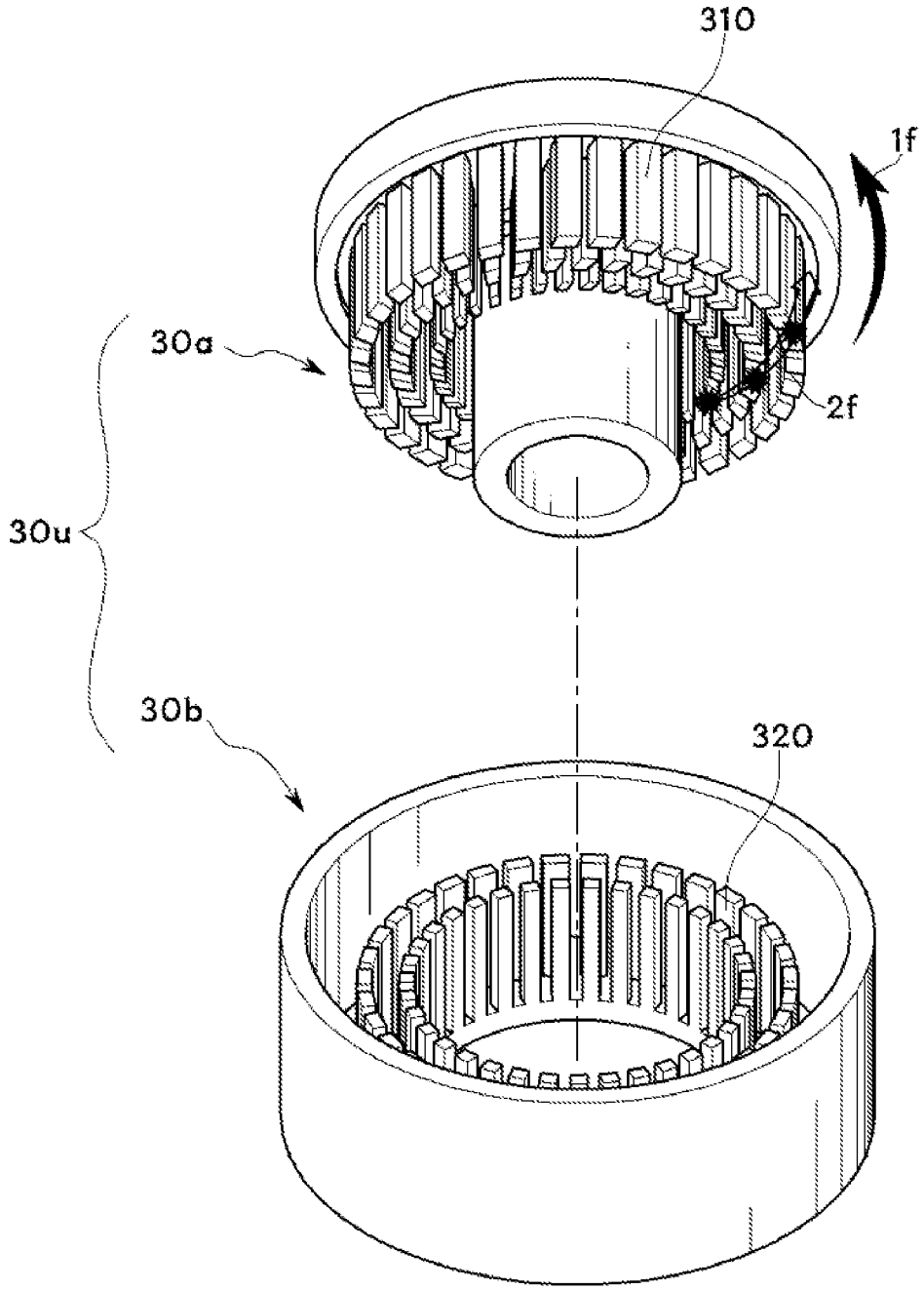
FIG. 4 is a functional diagram for describing the structures of a first rotor 30*a* and a second rotor 30*b* of the system structure 100 of an impeller for a rotor-rotor type dispersion-emulsion apparatus by the embodiment of the present invention.
Figure 5:
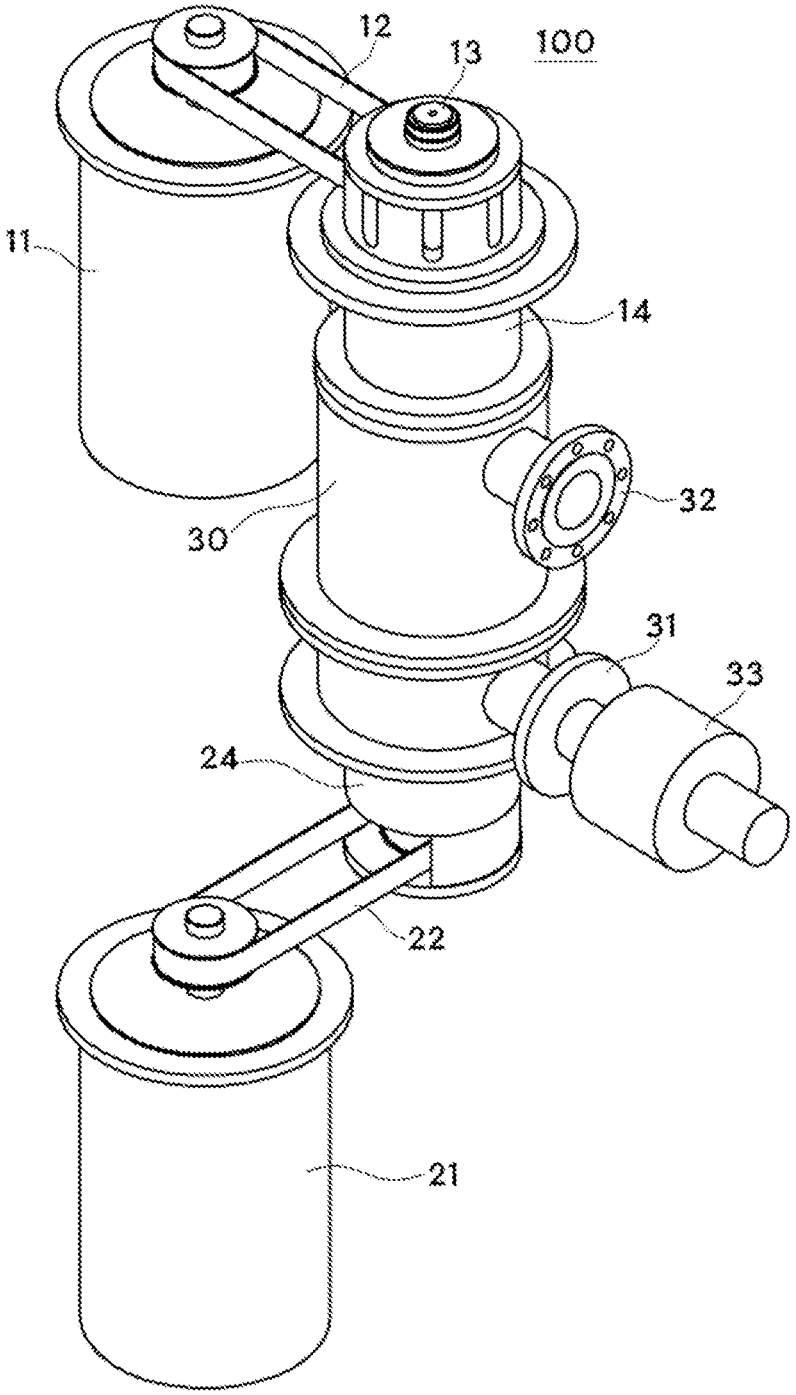
FIG. 5 is a perspective view of the system structure 100 of an impeller for the rotor-rotor type dispersion-emulsion apparatus by the embodiment of the present invention.
Figure 6A:
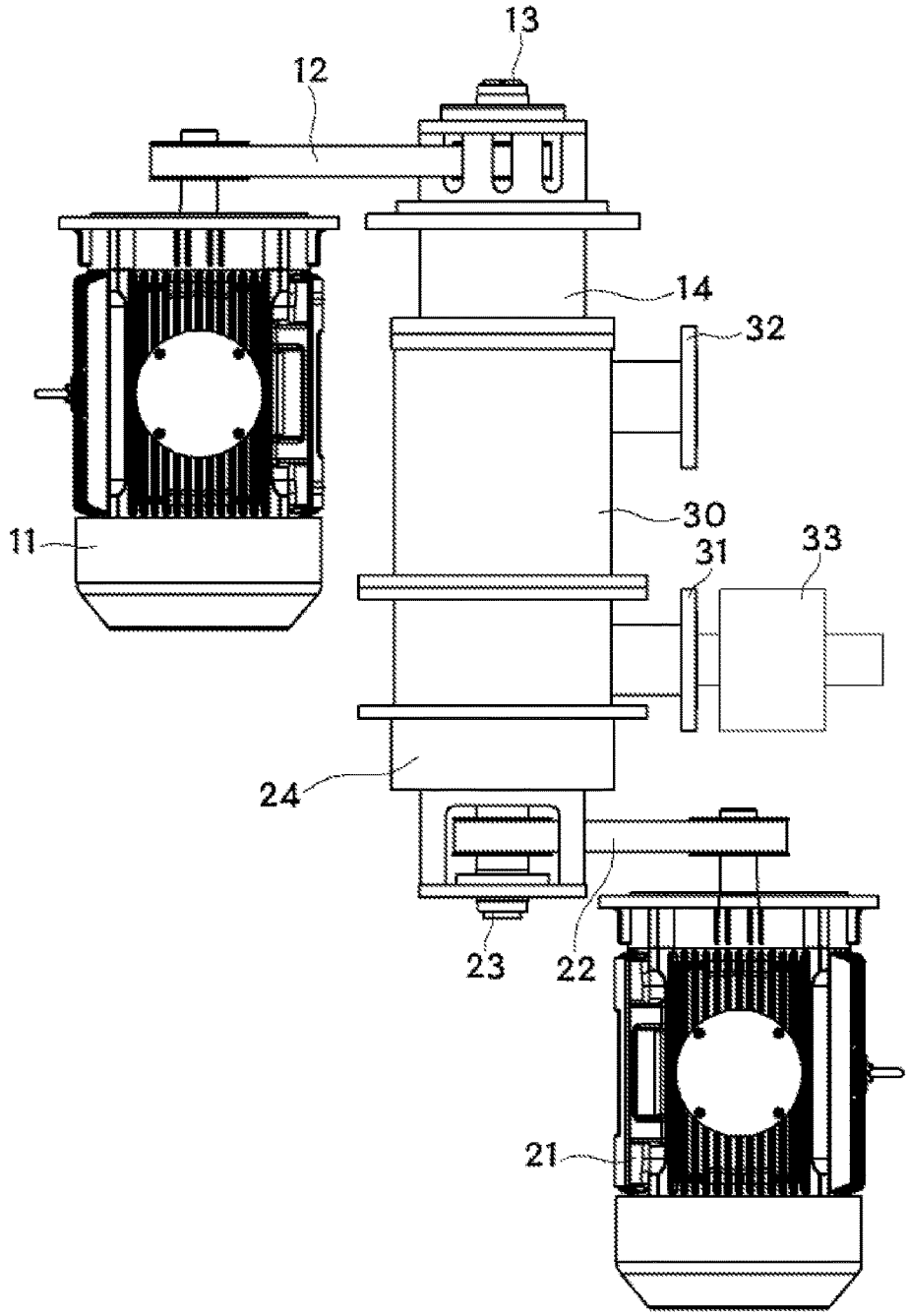
FIG. 6 illustrates a side view (FIG. 6*a*) and a plan view (FIG. 6*b*) of the system structure 100 of an impeller for the rotor-rotor type dispersion-emulsion apparatus by the embodiment of the present invention.
Figure 6B:
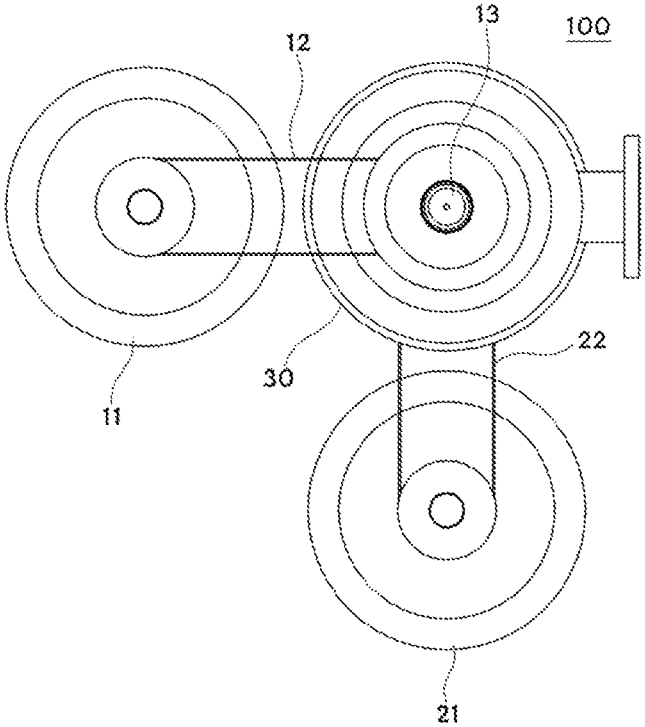

FIG. 4 is a functional diagram for describing structures of a first rotor 30*a* and a second rotor 30*b* of the system structure 100 of an impeller for a rotor-rotor type dispersion-emulsion apparatus by the embodiment of the present invention, FIG. 5 is a perspective view of the system structure 100 of an impeller for the rotor-rotor type dispersion-emulsion apparatus by the embodiment of the present invention, and FIG. 6 illustrates a side view (FIG. 6*a*) and a plan view (FIG. 6*b*) of the system structure 100 of an impeller for the rotor-rotor type dispersion-emulsion apparatus by the embodiment of the present invention.

Hereinafter, to describe with reference to FIGS. 3 to 6 which are accompanied, since the system structure 100 of an impeller for the dispersion-emulsion apparatus based on dual rotor switches the rotor-stator type of conventional technology to a rotor-rotor type multi-stage impeller structure, the system structure 100 is a system configuration which enhance efficiency of dispersion-emulsion significantly.

That is, a high-viscosity dispersion-emulsion apparatus by conventional technology is a scheme in which the material (substance) passes through micro interval between the stator which is stationary and the rotor which rotates, but in the present invention, the second rotor 30*b* corresponding to the stator which is stationary in conventional technology is rotated in the opposite direction to the first rotor 30*a*, and as a result, mobility and shearing energy of the material (substance) are enhanced, thereby enhancing dispersion-emulsion efficiency of a material of a high viscosity and low fluidity In more detail, the first driving shaft 13 connected with the first motor 11 through the first belt 12 rotates in a positive direction (in a counterclockwise direction) as the first motor 11 rotates in a positive-direction (counterclockwise-direction).

The first driving shaft 13 which is fixedly installed on the top of the center of the cylinder 30 which the top is sealed by the first mechanical seal 14 in a rotational state and elongates toward the bottom from the top receives power of the first motor 11 through the first belt 12 and rotates in the positive direction (counterclockwise direction).

In the following description, the rotational direction of the first motor 11 may be referred to as a first direction.

The first rotor 30*a* in which multiple first rotor teeth 310 which are fixedly installed on the outer periphery of the first driving shaft 13 in multiple stages or one or more stages or five stages and have a flat disk shape and are constituted by one or more embossing protrusions which are embossed (protrude) downward are arranged on a multi-stage circumference of the same center at a regular interval interlocks with the first driving shaft 13 to rotate in the positive direction (counterclockwise direction).

Herein, the circumference means a line formed by the corresponding circumference, and—it is described below being applied similarly that those skilled in the art may easily understand the meaning.

Herein, the number of the concentric circumferences in which the first rotor teeth 310 are arranged is one or more, and three circumferences are comparatively preferable, and the first rotor 30*a* installed on the first driving shaft 13 is configured by any one value selected from in a range of one to ten stages, and preferably by five, but it may increase or decrease according to need.

Meanwhile, the second driving shaft 23 connected with the second motor 21 through the second belt 22 rotates in a reverse direction (in a clockwise direction) according to the reverse-direction (clockwise-direction) rotation of the second motor 21.

In the following description, the rotational direction of the second motor 21 may be referred to as a second direction.

The second driving shaft 23 which is fixedly installed on the bottom of the cylinder 30 within the cylinder 30, the bottom of which is sealed by the second mechanical seal 24 in the rotational state, and is formed toward the top from the bottom, also rotates in the reverse direction (clockwise direction).

The second rotor 30*b* in which multiple second rotor teeth 320 which are fixedly installed on the outer periphery of the second driving shaft 23 in multiple stages or one or more stages or five stages, and have the flat disk shape, and are constituted by one or more embossing protrusions which are embossed (protrude) downward, are arranged on the multi-stage concentric circumferences at regular interval(s), interlocks with the second driving shaft 23, and rotates in the reverse direction (clockwise direction).

Herein, the number of concentric circumferences in which the second rotor teeth 320 are arranged is one or more, and two circumferences are comparatively preferable, and the second rotor 30*b* connected and installed onto the second driving shaft 23 is configured by any one value selected from the range of one to ten stages like the first rotor 30*a*, and preferably by five is configured by the fifth stage, but it may increase or decrease according to need.

In addition, as illustrated in FIGS. 3 and 4, the embossing protrusion of the second rotor 30*b* and the embossing protrusion of the first rotor 30*a* are configured not to overlap each other but engage with each other to cross each other, and the micro gap or clearance is formed between the embossing protrusions of the first rotor 30*a* and the embossing protrusions of the second rotor 30*b* which are disposed to cross each other to shear, disperse, mix, and emulsify the input material (substance).

To describe FIG. 4 in detail, if represents the rotational direction of the first rotor 30*a*, and 2*f* represents a direction of material movement. The first rotor 30*a* and the second rotor 30*b* form a high-viscosity dispersion impeller 30*u*, and the impeller 30*u* is configured in one or more multiple stages and is preferably configured by 5 stages, but the number of the stages may increase or decrease according to need.

It can be understood that the material (substance) moves diagonally along the clearance or the interval between the respective corresponding protrusion constituting the first rotor teeth 310 according to the rotation of the first rotor 30*a*.

The first rotor 30*a* and the second rotor 30*b* rotate respectively in the opposite directions, and the material (substance) which moves along the interval is sheared, dispersed, mixed, and emulsified by the corresponding protrusions of the first rotor 30*a* and the second rotor 30*b*, and such process is repeated in multi stages by the impeller which is configured in multi stages.

Therefore, the number of stages of the impeller may be increased and decreased according to given conditions and needs including an input material (substance), purpose, capacity, and etc., and in general, the impeller is preferably configured in 5 stages, and when the number of units in the impeller is small, the substance discharged to the outlet 32 may be made to flow into the material suction pump 33, and then flow into the inlet 31 again by driving the material suction pump 33, so that said substance may be put into the cylinder 30 again. And if the number of the units of the impeller is more than 5 stages, the efficiency may decrease.

Figure 7:
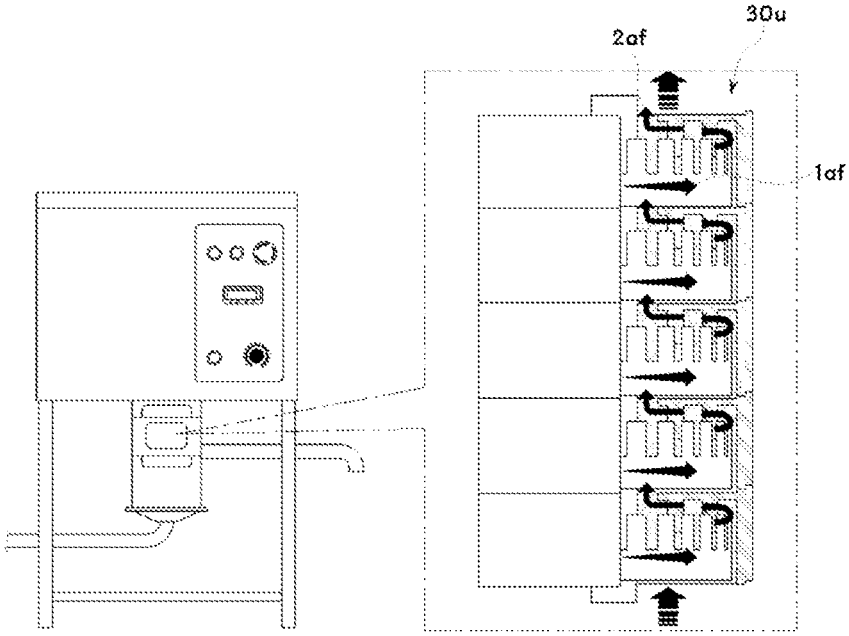
FIG. 7 is a functional diagram for describing an overall configuration of the system structure 100 of an impeller for the rotor-rotor type dispersion-emulsion apparatus including a control unit and a structure of a high-viscosity dispersion multi-stage impeller 30*u* by an embodiment of the present invention.

FIG. 7 is a functional diagram to describe an overall configuration of the system structure 100 of an impeller for the rotor-rotor type dispersion-emulsion apparatus including a control unit, and to describe the structure of multi-stage impeller 30*u* for a high-viscosity dispersion by an embodiment of the present invention.

Hereinafter, to describe with reference to all accompanying drawings, 1*af* and 2*af* in FIG. 7 represent the movement directions of the input material (substance).

That is, the dispersion-emulsion process is performed, in which the material (substance) input into the cylinder 30 through the material suction pump 33 and the inlet 31 provided on the lower side of the cylinder 30 is discharged through the outlet 32 formed on the upper side of the cylinder 30 in the same direction as the inlet 31, by sequentially passing along the impeller configuration where the high-viscosity dispersion impeller 30*u* constituted by the first rotor 30*a* and the second rotor 30*b* for each stage and repeated in multiple stages or 5 stages, by one pass scheme.

Even for a high-viscosity material (substance), since it is also smoothly supplied to the cylinder 30 by the material suction pump 33, the loads on the first motor 11 and the second motor 21 can be reduced, and the first motor 11 and the second motor 21 can increase the corresponding shearing force due to the reduces loads and further increase the dispersion-emulsion efficiency at the same time.

In the system structure 100 of an impeller for the dispersion-emulsion apparatus based on dual rotor, since the input material is dispersed and emulsified by the high-viscosity dispersion impeller 30*u* which includes the first rotor 30*a* and the second rotor 30*b*, the dispersion-emulsion efficiency is increased, and the input material (substance) may be subject to serial/parallel type three dimensional dispersion as the input material pass through the vertically configured multi-stage or 5 stage impeller 30*u* of rotor-rotor type to maximize the dispersion-emulation efficiency.

The system structure 100 of an impeller for the dispersion-emulsion apparatus based on dual rotor, which is configured by the high-viscosity dispersion multi-stage impeller 30*u* innovatively enhance the efficiency of a dispersion-emulation process by a one-pass flow type scheme.

Figure 8:
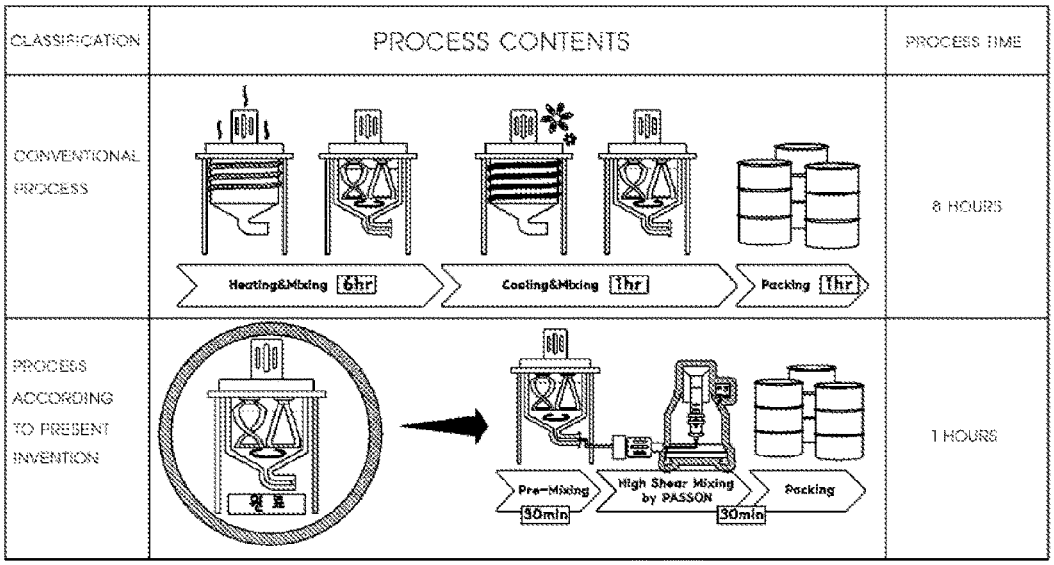
FIG. 8 is a diagram for describing processing sequences and processing time by a dispersion-emulsion process of a configuration by conventional technology and a rotor-rotor type configuration by an embodiment of the present invention.

FIG. 8 is a diagram for describing processing sequences and processing time of dispersion-emulsion processes of a configuration of the conventional technology and that of a rotor-rotor type according to the present invention by an embodiment.

Hereinafter, to explain advantages with reference to all accompanying drawings, in FIG. 8, in a flow type process where the process from the raw material input to the output of the target material of the dispersion-emulsion is done by one pass scheme, the process time is shortened to ⅛ level compared with the existing batch process, the production process time may be shortened, and production cost and defect rate are reduced.

Further, since the reaction time of the dispersion-emulsion target material is innovatively shortened and thus dispersion heat is not almost generated compared with the existing inline mixer, there is an advantage that there is almost no change in the physical property of the reactants by the dispersion-emulsion process.

Table 1 given below is a chart acquired by comparing the problems in dispersion-emulsion of the high-viscosity material and the advantages of the system structure 100 of an impeller for the rotor-rotor type dispersion-emulsion apparatus by an embodiment of the present invention.

TABLE 1

| Problems in the dispersion of high-viscosity material | Advantages of the rotor-rotor type dispersion apparatus 100 |
|---|---|
| High-viscosity material has a technical limit in high-dispersion implementation in terms of uniformity. | Implementation of dispersion-emulsion having high uniformity by the rotor-rotor type. |
| When the existing mixer is scaled up to a mixer beyond a laboratory level, high cost is required. | Processing from small capacity to large capacity is possible. |
| As the processing capacity increases, the stirring blind zone increases, quality deteriorates, and a long processing time is required (8 hours or longer) | The working time is significantly shortened by flow type one pass process from input up to the discharge of the raw material after the pre-mixing. |
| quantity and yield are low due to a underdeveloped process | The residence time of the dispersion reactor is significantly reduced, and as a result, there is no deterioration phenomenon due to heat generation during the dispersion-emulsion. |

The system structure 100 of an impeller for the dispersion-emulsion apparatus based on dual rotor by the embodiment of the present invention may be applied to a process requiring high-efficiency dispersion, emulsion, atomization, and mixing as well as a material industry, and also to broad span of fields including foods, cosmetics, medicine, rubber, adhesive, film, coating, ink, paint, fine chemistry, electronic materials, polymer industry, and etc.

That is, the system structure 100 of an impeller for the dispersion-emulsion apparatus based on dual rotor performs dispersion-emulsion processing by one pass flow scheme, and maybe applied to batch process where there are difficulties in processing time and quality, and the shearing energy, and uniform mixing and dispersion are required, therefore significant technological ripple effect is expected.

Hereinafter, the fields to which the system structure 100 of an impeller for the dispersion-emulsion apparatus based on dual rotor may be applied and examples for solving the problem will be described for each field.

<Ink Mixing/Preparation Process>

Since an ink preparation scheme is conventionalized, the ink preparation is a complicated process including material mixing, dissolver, 3 roll mill and bead mill dispersion, and then adding additives such as varnish, a solvent, and etc., and then dissolver process again.

When the system structure 100 of an impeller for the dispersion-emulsion apparatus based on dual rotor is applied to the process, the process time may be shortened by supplying high shearing energy in the material mixing and the dissolver process.

<Additive Mixing Process of Foam Insulation>

A very small amount of corresponding additives that foam an insulation is added in a foam insulation preparation process. Continuous mass production was impossible because the process of enabling uniform mixing of the additives very small amount of which is added during the production was comparatively difficult.

When the system structure 100 of an impeller for the dispersion-emulsion apparatus based on dual rotor is applied to the process, each of a small amount of additives and insulation may be injected to be dispersed and emulsified by one pass scheme, and as a result, the foam insulation may be continuously produced with a constant quality, the processing time of manufacturing production may be innovatively reduced, and insulation performance may be increased by 30%.

<Silicon GUM Blending>

The use of silicon which is generally used for the adhesive and the film has been extended so as to cover smart phone special protection film recently, but the process of dissolving silicon raw material from a gum state at the production site requires a long production time and large production cost because a corresponding storage tank needs to be heated at 130° C. and actuated for 48 hours and thereafter, cooled.

When the system structure 100 of an impeller for the dispersion-emulsion apparatus based on dual rotor is applied to the process, the corresponding process time is completed within approximately 5 hours by the high rotor-rotor shearing force enabling the mass production.

<Technique Thinly and Uniformly Dispersing Graphene>

Graphene used in a touch panel, a flexible display, an energy element electrode and an electromagnetic wave shielding film, vehicle heat wire glass, a solar battery, and a semiconductor chip, a transparent heater, a smart window, various sensors, printing electronic ink, and etc., are more excellent than other materials in terms of properties including conductivity, flexibility, and durability, and as a result, the graphene gets the spotlight as a dream new material, but, since the production process is complicated and the mass production is difficult, it is difficult to use the graphene in an actual life.

When the system structure 100 of an impeller for the dispersion-emulsion apparatus based on dual rotor is used, the graphene may be mass-produced with the methods utilizing the large rotor-rotor shearing force.

<Carbon Black>

Industrial carbon black is used in various application fields including printing ink, toner, coating, plastic, paper manufacturing, architecture, and the like, and in recent years, in exterior coating of a smart phone, too. Since the carbon black is much more difficult to be dispersed than other pigments, since an ingredient of the carbon black is carbon, and the carbon black are cohered to each other and are not thus separated from each other, it is difficult make products of constant quality.

When the system structure 100 of an impeller for the dispersion-emulsion apparatus based on dual rotor is used, the dispersion-emulsion of the carbon is processed by using the large rotor-rotor shearing force, and as a result, the corresponding product may be mass-produced with uniform quality.

<Metal Paste Dispersion>

Dispersion is very important for nano metal paste which is used in a chip condenser, a core component of the smart phone, and if the nano metal paste is not dispersed normally, an electric defect may be caused.

The chip condenser is a core component widely used in mobile devices including the smart phone, a tablet PC as well as in electronic products like a notebook computer and vehicles, and it serves to control a required amount of power to be supplied to each component at the proper time.

When the system structure 100 of an impeller for the dispersion-emulsion apparatus based on dual rotor is used, the nano metal paste is dispersed and emulsified by the large rotor-rotor shearing force, and as a result, the electric defect may be reduced and the chip condenser may be mass-produced with uniform quality.

<Dispersion of Medical Polymer Filler and Collagen>

A filler frequently used in a cosmetic surgery field means filling in English and is collectively referred to as a supplementing material that hides wrinkles, a caved scar, and the like by injecting or inserting and treating the filler in a skin in the cosmetic surgery field.

Currently, filler field is generally divided into a product using a hyaluronic acid ingredient as a bio material which exists in the skin of a human body and a product using a biocompatible polymer ingredient.

The product using the biocompatible polymer shows an efficacy for 2 years or longer through one treatment unlike the hyaluronic acid product which shows an effect only for 6 months to 1 year and has a feature that generation of collagen of a patient is induced in the skin, and as a result, it is known that a feeling of irritation is small and a natural effect like an actual tissue is shown.

A market scale of the filler in Korean cosmetic field is at a level of approximately 100 billion won and a global market of the filler is known as a large market over approximately 2 trillion won and the filler field is a field that is expected to be continuously growing with an increasing interest in population aging and beauty treatment.

Collagen is a biocompatible polymer, and is difficult to stir and mass-produce due to high viscosity, therefore, the raw material is very expensive.

When the system structure 100 of an impeller for the dispersion-emulsion apparatus based on dual rotor is used, the filler may be mass-produced utilizing the large rotor-rotor shearing force and one-pass type technology.

<Manufacturing Secondary Battery>

As demands for a battery and an energy storage system for an electric vehicle significantly increase together with a steady increase of an IT demand, a demand of the secondary battery (lithium battery) at 125 GWh is anticipated, and as a result, it is expected that the growth would be approximately 22% at an annual average.

The lithium battery has a problem in that the process of preparing slurry of an anode and a cathode by melting an active material and a binder with the solvent is not easy.

When the system structure 100 of an impeller for the dispersion-emulsion apparatus based on dual rotor is used, the large rotor-rotor shearing force and the one-pass type process are used, and as a result, the dispersion-emulsion time may be reduced to be very short, and a coating process which is a subsequent process may be immediately performed, and as a result, productivity may be enhanced, the defect may be reduced, and the production cost may be reduced.

Figure 9:
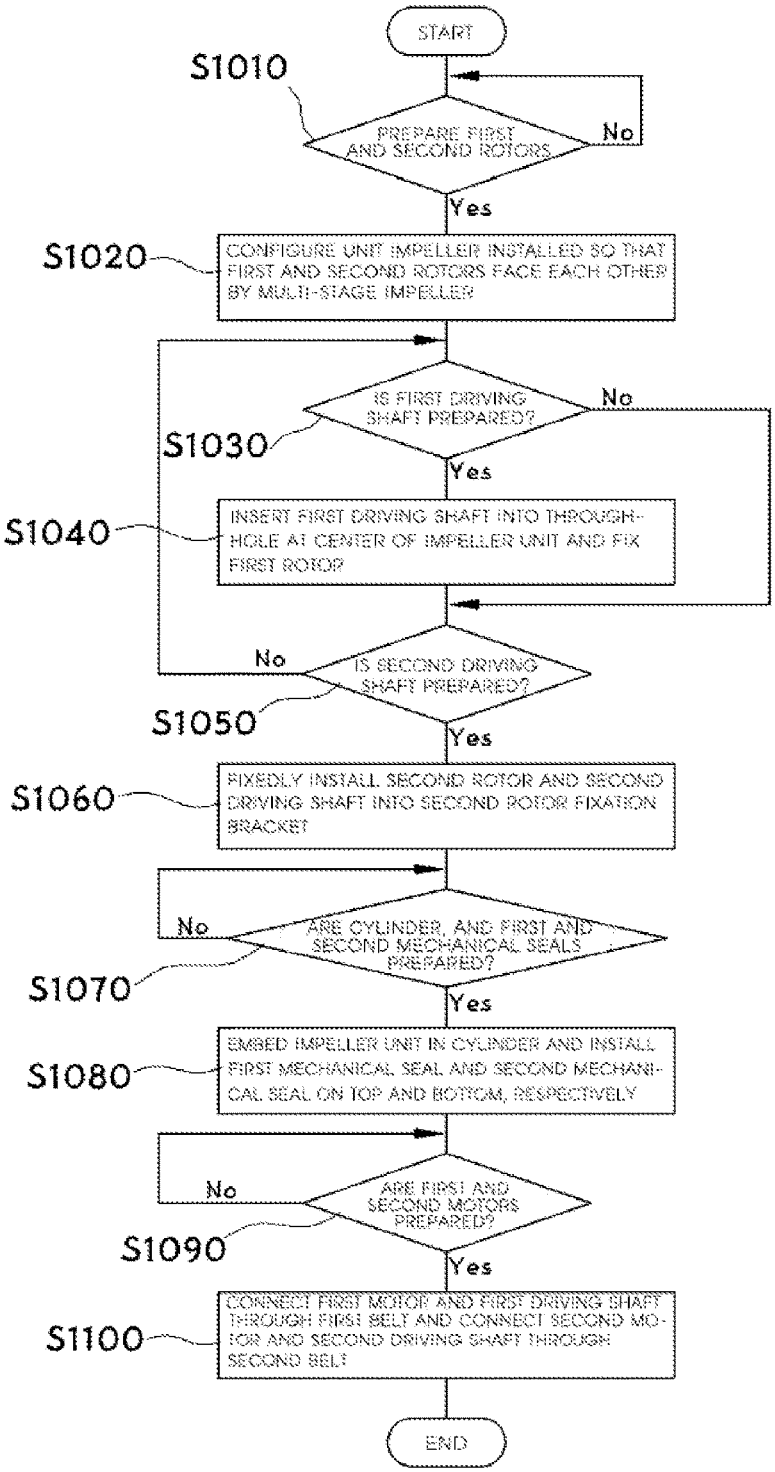
FIG. 9 is a flowchart for describing an installation and operation method of a system structure of an impeller for a rotor-rotor type dispersion-emulsion apparatus by an embodiment of the present invention.

FIG. 9 is a flowchart for describing an installation and operation method of a system structure of an impeller for a rotor-rotor type dispersion-emulsion apparatus by an embodiment of the present invention.

Hereinafter, to describe the installation and operation method in detail with reference to all accompanying drawings, one or more first rotors and second rotors are prepared in the installation and operation method of the system structure 100 of an impeller for the dispersion-emulsion apparatus based on a dual rotor, which includes the first driving shaft 13, the first rotor 30*a*, the first motor 11, the first belt 12, the first mechanical seal 14, the second driving shaft 23, the second rotor 30*b*, the second motor 21, the second belt 22, the second mechanical seal 24, and the cylinder 30 (S1010).

The first rotor teeth 310 constituting the first rotor face downward, and the second rotor teeth 320 constituting the second rotor face upward, and as a result, the first rotor and the second rotor are disposed to face each other.

In this case, the first rotor is inserted and installed into the second rotor so that the first rotor teeth and the second rotor teeth are adjacent to each other to form one unit impeller.

That is, the configuration in which one first rotor and one second rotor are disposed to-face each other will be hereinafter described as a unit impeller.

Unit impellers are vertically installed in vertical multiple stages, where the number of stages takes any one number selected from the range of 1 to 10 to form impeller part (S1020).

The configuration in which the unit impellers are vertically installed in the multiple stages will be hereinafter described as the impeller part.

The first driving shaft is prepared (S1030).

The first driving shaft is inserted into the impeller part or a first shaft fixation hole 312 which is a through-hole formed at the center of the first rotor to install the first rotor on the outer periphery of the first driving shaft in a fixed state.

As an embodiment of the first driving shaft, a stop projection is formed at one side of the top to restraint one or more first rotors from moving upward from a designated position, and a screw thread to which a nut is fastened is formed at the end of the bottom so as to fixedly install one or more multiple first rotors to the first driving shaft.

Further, as another embodiment, a first rotor fixing bracket, which is fixedly installed on the outer periphery of the first driving shaft and allows one or more multiple first rotors to be fixedly installed, may be provided at a lower end portion of the first driving shaft.

Since the fixed installation configuration is generally known, a concrete and detailed description will be skipped in the present invention.

The second driving shaft including a second rotor fixing bracket 230 is prepared (S1050).

One or more multiple edges of the second rotor is fixedly installed at a first fixation portion 232 formed at the edge of the second rotor fixing bracket having a disk shape. A bolt may be used or a generally known scheme may be used in this fixed installation.

The second driving shaft may be fixedly installed at a second fixation portion 234 penetratingly formed at the center of the second rotor fixing bracket, and bolt or generally known scheme may be used in the fixed installation (S1060).

The cylinder, the first mechanical seal, and the second mechanical seal are prepared (S1070).

Since the impeller unit in which the first driving shaft and the second driving shaft are fixedly installed is embedded inside the cylinder, and the first mechanical seal is installed on the top in a sealed state, the first driving shaft is fixedly installed in a rotational state. Further, since the second mechanical seal is installed on the bottom of the cylinder in the sealed state, the second driving shaft is fixedly installed in the rotational state (S1080).

Herein, it is described that the inlet and the outlet are installed in the cylinder.

The first motor and the second motor which include the first belt and the second belt are respectively prepared (S1090).

The first motor and the second motor are fixedly installed around the cylinder and the first motor and the first driving shaft are connected to each other through the first belt so as to transfer driving force of the first motor to the first driving shaft. Meanwhile, the second motor and the second driving shaft are connected to each other through the second belt so as to transfer the driving force of the second motor to the second driving shaft (S1100).

When installation of the system structure 100 of an impeller for the dispersion-emulsion apparatus based on dual rotor is completed, normal driving states of the first motor and the second motor are verified by connecting the power and after surrounding arrangement and washing are completed, the corresponding material are input into the inlet and subjected to the dispersion-emulsion processing to be discharged through the outlet.

In the present invention having such a configuration, the first rotor and the second rotor are provided and the first rotor and the second rotor rotate in the opposite directions to each other, and as a result, the corresponding material which is a target substance is subjected to the dispersion-emulsion processing for a state in which the particle size uniformity is enhanced.

As described above, preferred embodiments of the present invention have been disclosed in the present specification and the drawing, and although specific terminologies are used, but they are used in a general meaning to easily describe the technical content of the present invention and help understand the present invention, and are not limited to the scope of the present invention. In addition to the embodiments disclosed herein, it is apparent to those skilled in the art that other modified examples based on the technical spirit of the present specification can be implemented.

EXPLANATION OF REFERENCE NUMERALS

11: First motor
12: First belt
13: First driving shaft
14: First mechanical seal
21: Second motor
22: Second belt
23: Second driving shaft
24: Second mechanical seal
30: Cylinder
30*u*: High-viscosity dispersion multi-stage impeller
30*a*: First rotor
30*b*: Second rotor
31: Inlet
32: Outlet
100: System structure of impeller for dispersion-emulsion apparatus based on dual rotor
230: Fixation bracket
232: First fixation portion
234: Second fixation portion
310: First rotor tooth
312: First shaft fixation hole
320: Second rotor tooth
33: Material suction pump

What is claimed is:

1. A dual rotor structure of an impeller, the dual rotor structure comprising:

a first rotor having one or more sets of first rotor teeth and fixedly disposed on an outer surface of a first driving shaft, each first rotor tooth having a first flat plate shape and protruding downward, wherein the one or more sets of first rotor teeth are arranged at a first regular interval along one or more first concentric circumferences; and a second rotor having one or more sets of second rotor teeth and fixedly disposed on an outer surface of a second driving shaft, each second rotor tooth having a second flat plate shape and protruding upward, wherein the one or more sets of second rotor teeth are arranged at a second regular interval along one or more second concentric circumferences, wherein the first rotor and the second rotor are coupled to each other in a state where the one or more sets of first rotor teeth and the one or more sets of second rotor teeth are disposed to be apart from each other, wherein the one or more first concentric circumferences and the one or more second concentric circumferences share a same center and alternately disposed from the same center, and wherein the first rotor and the second rotor constitute each stage of a multi-stage impeller, the number of the multi-stage impeller being any one of 2 to 10.

2. The dual rotor structure of claim 1, wherein the first driving shaft is connected with a first rotor through a first belt and rotates unidirectionally in a first direction by driving the first motor, the second driving shaft is connected with a second motor through a second belt and rotates unidirectionally in a second direction by driving the second motor, and the first direction and the second direction are opposite to each other.

3. The dual rotor structure of claim 1, wherein the second rotor is fixedly coupled to a first fixation portion of a second rotor fixation bracket, and the second driving shaft is fixedly coupled to a second fixation portion of the second rotor fixation rotor bracket.

4. The dual rotor structure of claim 3, further comprising a cylinder configured to accommodate the first rotor and the second rotor, wherein the first driving shaft is disposed at a center of a top of the cylinder, and the second driving shaft is disposed at a center of a bottom of the cylinder.

5. The dual rotor structure of claim 4, wherein the first driving shaft penetrates the top of the cylinder in a sealed state by a first mechanical seal and is coupled to the cylinder in a rotational state, the second driving shaft penetrates the bottom of the cylinder in a sealed state by a second mechanical seal and is coupled to the cylinder in the rotational state, and wherein a first rotational axis center of the first driving shaft and a second rotational axis center of the second driving shaft are configured to be positioned on a same vertical line.

6. The dual rotor structure of claim 5, wherein the cylinder further comprises:

an inlet configured to input a material and disposed on a lower side of the cylinder; and an outlet configured to discharge the material and disposed on an upper side of the cylinder;

wherein each of a first rotational axis center line of the first motor and a second rotational axis center line of the second motor is inclined at an angle of 0 to 180° from the vertical line configured by the first rotational axis center of the first driving shaft and the second rotational axis center of the second driving shaft, or is disposed on the same vertical line, and wherein each of the inlet and the outlet is inclined at an angle of 0 to 180° from the vertical line configured by the first rotational axis center of the first driving shaft and the second rotational axis center of the second driving shaft, or is disposed on the same vertical line.

7. The dual rotor structure of claim 6, further comprising a material suction pump disposed on a front end of the inlet of the cylinder and configured to facilitate a flow of a high-viscosity material into the cylinder, wherein a material input into the cylinder through the material suction pump and the inlet disposed on the lower side of the cylinder is discharged through the outlet disposed on the upper side of the cylinder, by sequentially passing through the multi-stage impeller where each stage of the multi-stage impeller is constituted by the first rotor and the second rotor and is repeated in multiple stages.

* * * * *